United States Patent [19]

Tellie

[11] 3,999,318

[45] Dec. 28, 1976

[54] FIREARMS INVOLVING TWO EJECTION OUTLETS FOR EMPTY CASES

[75] Inventor: Paul Emile François Tellie, Saint-Etienne, France

[73] Assignee: Etat Francais, France

[22] Filed: May 27, 1975

[21] Appl. No.: 580,986

[30] Foreign Application Priority Data

June 25, 1974 France ..... 74.21982

[52] U.S. Cl. ..... 42/1 R

[51] Int. Cl.[2] ..... F41C 27/08

[58] Field of Search ..... 42/1 R, 1 T, 1 N, 16

[56] References Cited

UNITED STATES PATENTS

| | | | |
|---|---|---|---|
| 490,029 | 1/1893 | Mauser | 42/1 R |
| 2,288,202 | 6/1942 | Mossberg | 42/16 |
| 2,916,844 | 12/1959 | Hellstrom | 42/16 |

*Primary Examiner*—Charles T. Jordan
*Attorney, Agent, or Firm*—Stevens, Davis, Miller & Mosher

[57] ABSTRACT

A firearm including a forestock having a receives with two ejection outlets on opposite sides of a longitudinal plane of symmetry of the firearm, and a hood covering and removably connected to the stock. The hood has an elastic part and a shield covering one of the outlets. A fixing apparatus including elements integrally connected to the forestock and hood enable the shield to cover either of the two outlets. The hood is elastically distorted in a predetermined direction different from the direction of elastic distortions produced by predetermined forces from within the firearm so that the shield can withstand these forces.

6 Claims, 3 Drawing Figures

FIG. 1
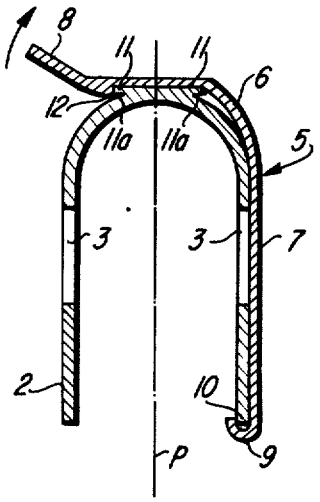
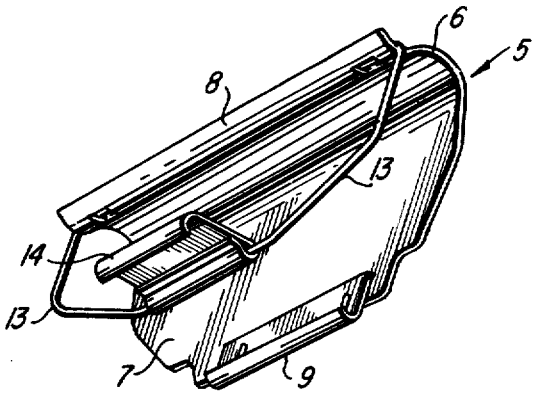
FIG. 2
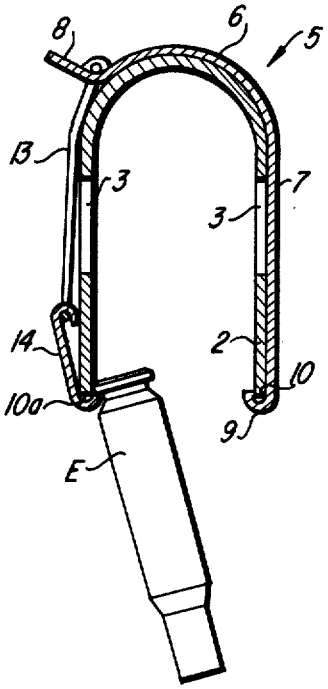
FIG. 3

FIREARMS INVOLVING TWO EJECTION OUTLETS FOR EMPTY CASES

This invention deals with improvements made on firearms, especially automatic firearms, which are set up in such a way that the evacuation of the empty cases may be carried out through either one of two distinct ejection outlets. This is an addition to the improvements on these firearms already disclosed in U.S. Pat. No. 3,952,440. In a general way, these improvements consisted of attaching firer-operated obturating means to the type of firearm involved, which would allow the firer to shield the outlet which is not in service.

The aforesaid patent also suggested, as a preferred means of reduction to practice, that the aforesaid obturating means be constituted by a removable hood, symmetrical in respect to its median transversal plane, designed to cap the upper part of the body of the weapon opposite the ejection outlets and extending on one side as a rigid lateral cover plate designed (when the hood is in place) to completely cover the ejection outlet located on the side of the aforesaid lateral plate. The aforesaid removable hood is held in place, without having to recur to special fixation means, by conferring to certain longitudinal areas on the hood (especially on its curved upper section) a certain elasticity allowing the hood to cover and grip tightly, through a slight elastic distortion, the part of the weapon on which it is adapted.

For more convenience, reference will hereinafter be made to such a hood as a "removable hood having an elastic engaging and disengaging part".

The improvements which the present application deals with relate to safety when using such a removable hood having an elastic engaging and disengaging part, and specifically to avoid any risk of disengagement and brutal expulsion of the hood in the case of a cartridge case exploding outside the cartridge chamber of the firearm.

It is conceivable, indeed, that such a cartridge explosion could cause, within the ejection outlets (one of which is masked by the rigid lateral shield of the removable hood), considerable pressures which would be exercised upon the aforesaid lateral shield and would provoke an elastic distortion of the hood, with the risk that it might become disengaged and violently expulsed on the side of the shooter. Such an incident is particularly serious in the case of a short shoulder piece firearm where the shooter's cheek is applied precisely against the rigid lateral shield of the removable hood.

The firearm featuring two ejection outlets for empty cases, according to the invention, is equipped with a removable hood having an elastic engaging and disengaging part and a rigid lateral shield. This aforesaid firearm is characterized by the fact that the aforesaid removable hood is constructed in such a way that the elastic distortions resulting from its engagement or disengagement by the shooter go in a different direction than the elastic distortion resulting from great forces or pressures (greater than those created by the explosion of a cartridge outside the chamber) which would then be withstood by the hood and its lateral shield covering the ejection outlet on the side of the aforesaid shield.

The firearm involving two ejection outlets for empty cases, according to the invention, is equipped with a removable hood having an elastic engaging and disengaging part and a rigid lateral shield. This aforesaid firearm is characterized by the fact that the aforesaid removable hood also features special fixation means, releasable by the shooter, these fixation means being constructed in such a way that, when they are in the set position, they are insensitive (that is they remain in this set position) to considerable forces or pressures (greater than those created by the explosion of a cartridge outside the chamber) which are exercised from within the gun upon the aforesaid rigid lateral shield through the ejection outlet located on the side of this shield.

Due to these measures, it is assured that with the removable hood in place and its fixation means in set position, there is no risk that an accidental explosion of a cartridge case outside the chamber might cause the disengagement and brutal expulsion of the aforesaid removable hood.

Now concerning the special releasable fixation means just mentioned, they can be constituted by any appropriate means, but it seems particularly advantageous to utilize for this effect one or the other of two modes of realization which will be dealt with presently.

In the first mode of reduction to practice, the part of the firearm which is to be covered over by the elastic curved upper part of the removable hood features two longitudinal ribs which are symmetrical in relation to the longitudinal symmetry of the firearm. These ribs each show a catching surface inclined from top to bottom and from the exterior towards the aforesaid symmetry plane. The removable hood is equipped along the free edge of its curved upper part with a gripping device, and the aforesaid removable hood features, on the internal face of its curved upper part, and on the side of the aforesaid gripping device, an inclined hooking lip designed to interlock with the catching surface of that longitudinal rib located on the same side as the gripping device, the unit being constructed in such a way that the firer can release the hooking lip from the hooking rib by an elastic distortion of the curved upper part of the removable hood, by exercising vertical ascensional hand pressure upon the gripping device of the aforesaid removable hood.

In the second reduction to practice means, the removable hood features, on the side opposite the rigid lateral shield, an articulated hooking device presenting a certain elasticity and comprising at its base a hook designed to grip a hooking base, such as for example a longitudinal edge, of one piece with the firearm itself, the aforesaid hook preferably being designed so as to be released by means of the grooved base of a cartridge case.

This invention will be better understood with the help of the following descriptive complement which will refer to the diagrams.

FIG. 1 represents, in cross-section, a removable hood featuring special releasable fixation means conforming to the first preferred reduction to practice of the invention.

FIGS. 2 and 3, lastly, represent in a perspective view from the bottom and in cross-section, respectively, a removable hood featuring special releasable fixation means conforming to the second preferred reduction to practice of the invention.

In order to make easier the understanding of the correlation between the abovementioned patent application and the present disclosure, the same reference numbers as in such application will be used to designate the same items.

FIG. 1 illustrates in cross-section the forestock of an assault weapon having a cartridge case receiver 2, of an inverted U shaped cross-section, the aforesaid receiver featuring two lateral outlets 3 for the ejection of empty cases and extending, towards the rear, into a short shoulder piece (not shown).

Either one of the ejection outlets 3 can be shielded, whether the shooter shoots from the right or the left, by means of a removable hood 5 having an elastic engaging and disengaging curved upper part 6 designed to elastically cover the upper part (also curved) of the stock 2, the aforesaid hood being extended on one side by a rigid lateral shield 7 which can completely cover the ejection outlet 3 located on the same side.

The bottom edge of the lateral shield 7 is equipped with a hook 9 curved inwardly and designed to grip the bottom edge 10 of the stock 2 located on the same side.

The hood 5 features on its free side, i.e., the side opposite to the shield 7, a longitudinal gripping tab 8.

The aforesaid hood 5 also includes special fixation means releasable by the shooter and insensitive to great internal over pressures exercised on the shield 7. The fixation means includes as a first type of reduction to practice, concerning the firearm itself, two longitudinal ribs 11 which are symmetrical in relation to the longitudinal symmetry plane (P) of the firearm and which both present a catching surface (11a) inclined from top to bottom and from the outside towards the aforesaid symmetry plane, and, concerning the hood 5, an inclined hooking lip 12 located on the internal face of the curved upper part 6 of the aforesaid hood 5, not far from tab 8. The hooking lip 12 is designed to interlock with the catching surface 11a of the rib 11 located on the same side as the aforesaid tab 8.

The dovetail linkage thus brought about by the interlocking of a rib 11 and the lip 12 prevents any uncontrolled disengaging and expulsion of the hood 5 following an accidental internal overpressure exercised on the shield 7 through the corresponding ejection outlet 3. Whenever the shooter wishes to release the hood 5, he need only exercise a vertical effort (see arrow) upon the tab 8, which, thanks to the elasticity of the curved upper part 6 of the aforesaid hood, causes the interlocked lip 12 and rib 11 to be freed.

A second type of reduction to practice, differing from the preceding one in the structure of the special releasable fixation means for the removable hood 5, is represented in FIGS. 2 and 3, in which the same reference numbers represent the same elements as in FIG. 1.

In this second type of reduction to practice, the special fixation means includes an elastic support 13 made of piano wire, of roughly trapezoidal shape articulated at its large base on the curved upper part 6 of the hood 5 close to the tab 8. This elastic support 13 features on its narrow base an articulated hook 14 designed to lock onto the lower edge or catch base 10*a* of the stock 2 opposite the edge 10 which hooks itself onto hook 9. Hook 14 is preferably slightly oversized so that it protrudes on the inside beyond the lower edge or catch base 10*a* and can therefore be grasped by the groove of a grooved cartridge case (E) so as to effectuate its disengagement and the release of the removable hood 5.

Evidently, and as a result of the preceding description, this invention does not limit itself in the least to this reduction to practice, or to those types of realizations for its various parts, which have been more explicitly indicated; on the contrary, it encompasses all its variants.

I claim:

1. A firearm having a longitudinal plane of symmetry, a receiver having first and second distinct ejection outlets for cartridge cases on either side of said plane of symmetry, a hood removably connected to said receiver and including a rigid shield covering one of said outlets and an elastic engaging and disengaging part for connecting said hood to said receiver to cover either of said outlets, first and second longitudinal ribs which are an integral part of said receiver, said ribs being symmetrically located on opposite sides of and in parallel relation to the longitudinal plane of symmetry of the firearm, each of said ribs having a catching surface on an exterior side of said receiver and inclined from top to bottom towards the longitudinal plane of symmetry, an inclined hooking lip connected to said elastic part on the side of said hood facing the exterior of said receiver and on the same side of the longitudinal plane of symmetry as said uncovered outlet, said lip interlocking with the catching surface which is on the same side of the longitudinal plane of symmetry as said uncovered outlet, and a gripping device connected to said hood on the same side of the longitudinal plane of symmetry as said hooking lip.

2. A firearm having a longitudinal plane of symmetry, a receiver having first and second distinct ejection outlets for cartridge cases on either side of said plane of symmetry, a hood removably connected to said receiver and including a rigid shield covering one of said outlets and an elastic engaging and disengaging part for connecting said hood to said receiver to cover either of said outlets, an elastic hooking device connected to said hood on the same side of the longitudinal plane of symmetry as said uncovered outlet and having at its base a hook, and a catch base integrally connected to said receiver on the same side of the longitudinal plane of symmetry as said uncovered outlet, in which said hook grasps onto said catch base.

3. A firearm according to claim 2 wherein said hook includes means protruding from said catch base, whereby said hook may be removed from said catch base by prying with the base of a cartridge case.

4. Apparatus for a firearm including a receiver having first and second distinct ejection outlets for cartridge cases, comprising: a hood, removably connectable to the receiver, including a rigid shield for covering one of said outlets, and an elastic engaging and disengaging part enabling said hood to be connected to the receiver to cover either of the outlets, and releasable fixation means for releasably fixing said hood to the receiver, said means being capable of remaining in a set position on the receiver when predetermined forces from within the firearm act towards said shield through the outlet which it covers, said fixation means includes an inclined hooking lip connected to said elastic part on one side of said hood which faces the exterior of the receiver, for interlocking with the receiver, and a gripping device connected to said hooking lip, said elastic part extending between said shield and said hooking lip.

5. Apparatus for a firearm including a receiver having first and second distinct ejection outlets for cartridge cases, comprising: a hood, removably connectable to the receiver, including a rigid shield for covering one of said outlets, and an elastic engaging and disengaging part enabling said hood to be connected to the receiver to cover either of the outlets, and releasable fixation means for releasably fixing said hood to the receiver, said means being capable of remaining in a set position on the receiver when predetermined forces from within the firearm act towards said shield through the outlet which it covers, said fixation means comprises: an elastic hooking device connected on the side of said hood opposite said shield and having at its base a hook for hooking onto the receiver.

6. Apparatus according to claim 5 wherein said hook includes means protruding from the receiver, whereby said hood may be removed from the receiver by prying with the base of a cartridge case.

* * * * *